US006267861B1

(12) United States Patent
Kinard et al.

(10) Patent No.: US 6,267,861 B1
(45) Date of Patent: Jul. 31, 2001

(54) METHOD OF ANODIZING VALVE METALS

(75) Inventors: John Tony Kinard; Brian John Melody, both of Greer; David Alexander Wheeler, Williamston, all of SC (US)

(73) Assignee: Kemet Electronics Corporation, Greenville, SC (US)

( * ) Notice: Subject to any disclaimer, the term of this patent is extended or adjusted under 35 U.S.C. 154(b) by 0 days.

(21) Appl. No.: 09/676,672

(22) Filed: Oct. 2, 2000

(51) Int. Cl.[7] ..... C25D 11/26

(52) U.S. Cl. ..... 205/171; 205/175; 205/234; 205/322; 205/332

(58) Field of Search ..... 205/171, 174, 205/175, 234, 322, 332

(56) References Cited

U.S. PATENT DOCUMENTS

| | | | |
|---|---|---|---|
| 3,180,809 | 4/1965 | Gregori et al. . | |
| 3,359,191 | 12/1967 | Minami et al. . | |
| 3,496,424 | 2/1970 | Behrend . | |
| 3,563,863 | 2/1971 | Vierow . | |
| 3,796,644 | 3/1974 | Bernard . | |
| 3,943,041 | 3/1976 | Jackson . | |
| 4,196,060 | 4/1980 | Patrie et al. . | |
| 4,383,897 | 5/1983 | Gillich et al. . | |
| 4,388,156 | 6/1983 | Gillich et al. . | |
| 4,476,517 | 10/1984 | Fresin . | |
| 4,479,166 | 10/1984 | Finkelstein et al. . | |
| 4,781,802 | 11/1988 | Fresia . | |
| 4,823,236 | 4/1989 | Fresia . | |
| 5,111,365 | 5/1992 | Dapo . | |
| 5,211,741 | 5/1993 | Fife . | |
| 5,211,832 | 5/1993 | Cooper et al. . | |
| 5,385,662 | 1/1995 | Kurze et al. . | |
| 5,560,761 | 10/1996 | Naito . | |
| 5,580,367 | 12/1996 | Fife . | |
| 5,580,825 | 12/1996 | Labunov et al. . | |
| 5,587,871 | 12/1996 | Ue et al. . | |
| 5,605,561 | 2/1997 | Iwabuchi et al. . | |
| 5,674,371 * | 10/1997 | Patel | 205/105 |
| 5,687,057 | 11/1997 | Dapo . | |
| 5,716,511 | 2/1998 | Melody et al. . | |
| 5,820,740 * | 10/1998 | Le et al. | 205/171 |
| 5,837,121 | 11/1998 | Kinard et al. . | |
| 5,935,408 | 10/1999 | Kinard et al. . | |

FOREIGN PATENT DOCUMENTS 537474 6/1941 (GB) .

OTHER PUBLICATIONS

Brian Melody and Bill Chavez, "An Improved Series Of Electrolytes For Use In The Anodization Of Tantalum Capacitor Anodes", pp. 1–11, presented on Mar. 17, 1992.

Frederick A. Lowenheim, "Electroplating", pg. 139, dated Jan. 8, 1979.

* cited by examiner

*Primary Examiner*—Bruce F. Bell
*Assistant Examiner*—William T. Leader
(74) *Attorney, Agent, or Firm*—Banner & Witcoff, Ltd.

(57) ABSTRACT

A method of non-thickness-limited anodizing for valve metals and alloys which are resistant to the non-thickness-limited growth of anodic oxide, such as niobium and high niobium content alloys. Non-thickness-limited anodic oxide film growth is produced on such valve metals by employing a first glycerine-based electrolyte containing about 1 to about 3 wt % water for the initial production of anodic oxide. After the substrate is anodized using the first electrolyte, it is immersed in a second glycerine-based electrolyte having less than about 0.1 wt % water. The second electrolyte may be produced by allowing water to evaporate from the first electrolyte solution until the solution contains less than about 0.1 wt. % water.

15 Claims, No Drawings

METHOD OF ANODIZING VALVE METALS

FIELD OF THE INVENTION

The invention is directed to non-thickness-limited anodizing of valve metals and alloys, particularly niobium and its alloys.

BACKGROUND OF THE INVENTION

Anodic oxide films have been employed commercially for over 100 years. These films find use in a variety of industrial applications, including electrolytic capacitors, rectifiers for converting alternating current to direct current, lightning arrestors, insulation on aluminum and aluminum alloy motor and transformer windings, as decorative coatings on furniture and appliances, as decorative coatings on niobium and titanium jewelry, and as a hard wear surface on aluminum or titanium machine and aircraft parts.

Anodic oxide films have traditionally been categorized as belonging to one of two basic types of film. The first type is the non-barrier or decorative type of film. These oxide films are usually grown on aluminum, titanium, or alloys thereof in electrolyte solutions which partially dissolve the oxide film.

Anodic aluminum films grown in cold sulfate or phosphoric acid solutions are porous, having a very large number of pores, generally of hexagonal shape, through which the electrolyte is in contact with the base metal (through a relatively thin oxide layer at the bottom of each pore) and supplies oxygen for continued anodic oxide growth so long as current is supplied. These films are usually grown with less than 50 volts applied across the anodizing cell. The pores in these films readily accept a wide variety of dyes, and they may be exposed to dye during or after the anodizing process. The pores for both decorative and wear-resistant anodic films on aluminum or its alloys are usually sealed by exposure to solutions which cause the pores to fill with a bulky aluminum oxide hydration product. Nickel acetate solutions have frequently been used to seal decorative and wear surfaces on aluminum.

Decorative anodic films on titanium are usually produced in cold sulfuric acid electrolyte solutions. Although these films are less porous than decorative films on aluminum and tend to be more uniform in thickness, they tend to be of a lamellar structure and are sometimes present as a series of very thin layers connected at many points and appearing uniform and continuous to the naked eye. The uniformity of thickness and transparency of anodic films on titanium produced in cold sulfuric acid solutions results in a vivid series of interference colors, similar to those characteristic of the so-called barrier anodic films on tantalum, so that no dyes are required to produce decorative results. The lamellar structure of these films, mentioned above, probably accounts for the observation that they tend to not be as effective as thermally produced films for the purposes of wear or corrosion resistance.

The second basic type of anodic oxide film is the barrier film. This type of anodic oxide is generally produced in electrolyte solutions which are relatively non-corrosive toward the substrate metals upon which the films are grown although barrier films may be produced on aluminum in electrolyte solutions which have significant solvent action on the hydrated forms of the oxide, such as borate solutions. Barrier anodic oxide films tend to be very uniform in thickness with the thickness being directly proportional to the applied voltage and the absolute (Kelvin) temperature of the electrolyte solution as described by Torissi (Relation of Color to Certain Characteristics of Anodic Tantalum Films, *Journal of the Electrochemical Society,* Vol. 102, No. 4, April 1955, pp. 176–180).

Barrier anodic oxide films age down to very low current values when held at constant voltage in barrier film forming electrolytes, in contrast to non-barrier films which grow thicker as long as voltage is applied. Barrier anodic oxide films also exhibit the property of rectification; they are highly insulating with the base metal positive relative to the electrolyte solution and readily pass electric current with the base metal biased negative relative to the electrolyte solution. The rectification or electronic valve action has led to the name valve metals, for the group of metals upon which anodic films can be grown which exhibit this property. Barrier anodic oxide films have traditionally been limited to relatively thin layers, generally well under a micron in thickness. This is due to the extremely small amount of barrier oxide produced per volt applied, 10–25 angstroms per volt depending upon the valve metal. This results in electric fields of up to 10,000,000 volts/cm across the thickness of the oxide. In order to prevent electron avalanche failure of barrier anodic oxide films at these high field levels, it has been found necessary to employ higher resistivity electrolytes to produce higher voltage films. The breakdown voltage of these films has been found to be proportional to the logarithm of the electrolyte resistivity. Electron avalanche failure of barrier films generally limits the maximum voltage to well under 1,000 volts or less than one micron in thickness. The maximum voltage obtained with traditional barrier film anodizing techniques is approximately 1,500 volts, obtained by Lilienfeld (U.S. Pat. Nos. 1,986,779 and 2,013,564) using polyglycol borate electrolytes, which produced barrier oxide films on aluminum of approximately 1.5 microns in thickness.

It has been recognized for some time that, for some applications in the electronics, aerospace, and chemical industries, it would be very useful to have the capability of producing very thick barrier-type anodic oxide films. It has also been widely recognized that a method of producing very thick (i.e., over one micron thick) barrier oxide films capable of withstanding very high applied voltages (i.e., over 500 volts) with relatively low anodizing voltage is highly desirable. Just such an anodizing method was developed in 1997 and is the subject of U.S. Pat. Nos. 5,837,121 and 5,935,408, Kinard et. al., as well as co-pending application Ser. No. 09/090,164, now U.S. Pat. No. 6,149,793 and Ser. No. 09/265,593.

This method of producing barrier-type anodic oxide films of unlimited thickness on valve metals at relatively low anodizing cell voltages (dubbed, Non-Thickness-Limited or N-T-L anodizing by the inventors) was also described in a technical paper, The Non-Thickness-Limited Growth of Anodic Oxide Films on Valve Metals, published in *Electrochemical and Solid State Letters,* Vol. 1, No. 3, September 1998, pp. 126–129.

Non-Thickness-Limited anodizing, as described in U.S. Pat. Nos. 5,837,121 and 5,935,408, Kinard et. al., consists of the application of relatively low voltage (about 30 volts or less) to a valve metal object immersed in a glycerine solution of dibasic potassium phosphate containing less than about 0.1% water and at a temperature above about 150° C. in order to produce a barrier anodic oxide film on the surface of the valve metal object. Basic salts, other than dibasic potassium phosphate, were found to result in fairly rapid polymerization of the glycerine to polyglycerine accompanied by the evolution of water.

It was found that thermally stable acid salts giving a solution pH of 4–7 may be employed (in place of the dibasic potassium phosphate) in combination with the glycerine solvent for non-thickness-limited anodizing of valve metals, as described in co-pending application Ser. No. 09/090,164.

It was found that, after a period of days at temperatures above 150° C., the glycerine-based electrolyte solutions employed for non-thickness-limited anodizing contain so little water (below 0.05%) that the N-T-L anodizing may prove difficult to initiate. It was found that a thin anodic oxide film applied to the valve metal substrate prior to N-T-L anodizing, such as a 3-volt anodic oxide film applied in room temperature dilute phosphoric acid, provides a film sufficiently thick to then be converted readily to non-thickness-limited anodizing kinetics upon immersion in an N-T-L electrolyte above 150° C. and applying voltage (i.e., the valve metal substrate with the preformed film gives rise to N-T-L anodizing more readily in low water content N-T-L electrolytes than does a valve metal substrate without a thin pre-formed film). This phenomena is described in co-pending application Ser. No. 09/265,593, which is primarily concerned with the use of constant current anodizing to produce a predictable anodic oxide film thickness under non-thickness-limited anodizing conditions.

Unfortunately, some valve metals, most notably niobium and niobium alloys, have proven difficult to anodize under non-thickness-limited anodizing kinetics due to the difficulty in initiating N-T-L film growth with these materials. The electronic leakage current through the native or passive oxide film which forms on the surface of niobium and alloys such as Nb/1%Zr is sufficiently high that little or no ionic current (necessary for anodic film growth) flows through the passive film upon application of voltage in N-T-L anodizing solutions at the required temperatures (i.e., in 10 wt. % dibasic potassium phosphate solution in glycerine containing less than 0.1 wt. % water and maintained at a temperature above 150° C.).

SUMMARY OF THE INVENTION

The invention is directed to a method of non-thickness-limited anodizing valve metals and alloys, in particular niobium and niobium-containing alloys.

The invention is particularly directed to a method of non-thickness-limited anodizing of a valve metal or valve metal alloy substrate comprising immersing the substrate in a first glycerine-based electrolyte comprising more than 0.1 wt % water, preferably about 1 to about 3 wt % water, and at a temperature of at least 150° C., and applying sufficient first anodizing potential to form an oxide film on the substrate; then immersing the substrate in a second glycerine-based electrolyte having less than about 0.1 wt % water and at a temperature of at least 150° C., and applying sufficient second anodizing potential to form a non-thickness limited oxide film on the substrate.

In a preferred embodiment of the invention, the water in the first glycerine-containing electrolyte is evaporated to form the second glycerine-containing electrolyte.

It is to be understood that both the foregoing general description and the following detailed description are exemplary and explanatory only and are not restrictive of the present invention as claimed.

DETAILED DESCRIPTION OF THE PREFERRED EMBODIMENTS

The present invention is directed to the production of anodic oxide films on valve metals via anodic polarization in a liquid electrolyte under conditions which result in the production of adherent, coherent, non-porous films of unlimited thickness at a fixed and relatively low (less than 100 volts) D.C. potential. This type of "non-thickness limited" anodizing stands in contrast to traditional anodizing, which produces anodic films having a thickness in direct proportion to the applied voltage and absolute temperature of the electrolyte.

The present invention is particularly directed to producing such non-thickness-limited films on valve metals such as niobium that are difficult to initiate non-thickness-limited anodizing.

It was observed that niobium and its alloys are resistant to undergoing non-thickness-limited anodizing kinetics. Even with a significant thickness of traditionally formed anodic oxide present, niobium and niobium alloy anode surfaces tend to exhibit electronic leakage currents to the point of preventing the flow of ionic current necessary for anodic oxide formation when electrified in non-thickness-limited anodizing electrolytes. The films formed by exposure to the atmosphere and by traditional anodizing methods and electrolytes are not sufficiently electrically insulating and thermally stable to support non-thickness-limited anodizing kinetics.

It was discovered that electrolytes, suitable for non-thickness-limited anodizing (i.e., thermally stable glycerine solutions of ionogens) but containing more than about 0.1 wt. % water, in particular 1 to 3 wt % water, may be used to produce anodic oxide films on the surfaces of niobium and niobium alloys which are significantly more thermally stable than films produced in aqueous electrolytes.

First, an anodic oxide film is grown on a niobium or niobium alloy substrate by immersing the substrate in a non-thickness limited electrolyte solution having more than 0.1 wt % water, preferably about 1 to about 3 wt % water, and at a temperature of at least 150° C. An anodizing potential is applied, while maintaining the solution at or above about 150° C. The anodizing potential applied to initiate the oxide film growth is about 5 to about 30 volts, preferably about 20 to about 30 volts.

After the initial oxide film growth, the substrate is transferred to a non-thickness-limited anodizing electrolyte having water content below about 0.1 wt. % water at a temperature above about 150° C. Voltage is then applied to produce non-thickness-limited anodic films. Alternatively, the water in the electrolyte solution containing more than 0.1% water is allowed to evaporate to achieve the non-thickness-limited anodizing electrolyte having water content below about 0.1 wt. % water. In other words, once the substrate is coated with the initial anodic oxide film, the temperature is maintained in excess of 150° C., and the voltage is applied continuously while the water content of the electrolyte solution is reduced by evaporation. As the water content drops below about 0.1%, the anodizing kinetics change to non-thickness-limited kinetics and a thick, uniform barrier oxide coating is produced.

A non-thickness-limited anodizing electrolyte and has a water content of less than about 0.1 wt % water. The electrolyte used to initiate oxide growth on the niobium or niobium alloy substrate is the same non-thickness-limited anodizing electrolyte with a water content of about 1 to about 3 wt % water. It is preferred that both electrolytes are the same but for the water-content. However, different electrolyte solutions are also contemplated for the first and second glycerine-containing electrolytes.

The method of the invention is very effective to obtain the desired non-thickness-limited oxide growth on niobium substrates. This is in contrast to the negative results obtained with niobium and high niobium alloys if the non-thickness-limited anodizing electrolyte (for example, 10 wt. % dibasic potassium phosphate in glycerine) containing less than about 0.1 wt. % is used to anodize niobium anode materials at temperatures below about 150° C. (e.g., 100° C.) with the temperature then being increased to 150+° C. in an attempt to initiate non-thickness-limited anodizing kinetics.

As mentioned above, the present invention uses glycerine-based electrolytes which are useful for non-thickness limited anodizing above 150° C. Due to its low pH, these electrolytes are not susceptible to polymerization of the glycerine. Such glycerine-based electrolytes are described in U.S. Pat. Nos. 5,837,121 and 5,935,408, and in co-pending Ser. No. 09/265,593, each of which is incorporated by reference in its entirety. For example, the glycerine-based electrolytes may comprise phosphate salt ionogens or acid salt ionogens. Solutions having acid salt ionogens typically have a pH of less than 7. The glycerine-based electrolytes are then modified by the addition of water to provide a water content of 1 to 3 wt %.

U.S. Pat. Nos. 5,837,121 and 5,935,408 describe electrolytic solutions of dibasic potassium phosphate in glycerine. Such electrolytic solutions can be prepared, for example, by mixing the phosphate and glycerine together at room temperature such as by stirring. The dibasic potassium phosphate is added in amounts of about 0.1 to 15 wt %, preferably about 2 to 10 wt %, based on the total weight of solution.

In co-pending application Ser. No. 09/265,593, electrolytes suitable for non-thickness-limited anodizing are produced by dissolving an organic acid salt, an inorganic acidic salt, or mixtures thereof in glycerine or by producing acidic salts in situ via addition of acidic and basic ionogen components to the glycerine. By mixtures thereof, it is meant a mixture of acidic salts, a mixture of basic salts, or a mixture of acidic and basic salts. The solution is then heated to above about 150° C. and the water content is reduced to below 0.1 wt %. The pH level is below about 7, and preferably between about 4 and 7.

Alternatively, suitable acidic salts are formed in situ via addition of acidic and basic ionogen components. The salt nature of the ionogen prevents consumption of the acidic component of the electrolyte in the production of esters with the elimination of water as occurs with straight acid solutions above 150° C. Preferably an organic salt is combined with a non-volatile organic or inorganic acid. Suitable salts include potassium acetate, sodium bicarbonate and potassium formate. Suitable inorganic acids and salts include sulfuric acid and potassium hydrogen sulfate. Suitable organic acids include P-toluene sulfonic acid, and tartaric acid. Preferably potassium acetate is mixed with sulfuric or tartaric acid to form, for example monobasic potassium tartrate.

The process of the invention is particularly useful for niobium and its alloys which have been difficult to anodize with the non-thickness-limited process describe in the co-pending application. Preferably, the niobium alloys contain at least about 50 atomic % niobium. The process may be used to produce anodic films on other types of metals including other "valve" metals such as aluminum, tantalum, titanium, zirconium, silicon, although the two-step anodization process of the invention may not be necessary for these other metals.

After the initial oxide film is formed, anodic films, prepared with the non-thickness-limited electrolytic solution may be produced at constant voltage, with the film thickness being approximately proportional to the time held at voltage at a constant temperature above about 150° C. The rate of film growth in these solutions is a function of both the applied voltage and electrolyte temperature. There is no known upper limit to the thickness of a film produced in accordance with the invention.

There are unlimited applications for the electrolytic solution of the invention including the production of electrolytic capacitors, rectifiers, lightning arrestors, and devices in which the anodic film takes the place of traditional electrical insulation, such as special transformers, motors, relays, etc. In addition, because of the uniformity obtained with the invention, the process of the invention may be used in the production of surgical implants where a minimum of induced currents is desirable. The rapid rate of growth achieved with the invention also allows for the production of practical anti-seize coatings for connectors and plumbing fabricated from valve metals and alloys.

EXAMPLES

The invention will be further described by reference to the following examples.

These examples should not be construed in any way as limiting the invention.

Example 1 (Comparative)

In order to demonstrate the difficulty in initiating non-thickness-limited anodic oxide formation on niobium and alloys of high niobium content by coating the anode with a thin layer of traditional anodic oxide prior to anodizing in the non-thickness-limited mode, as described in co-pending application Ser. No. 09/265,593, the following test was conducted.

A coupon of dimensions 4"×1" was cut from 0.01" thick Cabot niobium/1 wt. % zirconium alloy foil. The coupon was rinsed with acetone to remove any rolling oils or other organic materials. The coupon was then immersed to a depth of 2" in a 1 vol. % electrolyte solution of phosphoric acid at room temperature and a positive bias of 5 volts was applied to the coupon. The coupon rapidly aged-down in current at 5 volts. After 10 minutes at 5 volts, the current had decayed from an initial value of over 12 milliamperes to a value of 0.023 milliampere, indicating the presence of a 5 volt traditional anodic oxide film having high electrical resistance.

The coupon was then transferred to a non-thickness-limited electrolyte solution (10 wt. % dibasic potassium phosphate/90 wt. % glycerine) containing less than 0.1 wt. % water and maintained at a temperature above 150° C.

No additional anodic oxide was produced upon the application of 0.2, 0.4, and 0.8 milliamperes/cm$^2$ of coupon surface, the current being consumed as electronic leakage current.

Example 2 (Comparative)

In order to further demonstrate the difficulty of initiating non-thickness-limited anodic oxide production on niobium and high niobium alloy anode materials, a coupon was prepared from the Cabot niobium/1% zirconium foil, as used in Example 1. This coupon was anodized traditionally, at room temperature, in 1 vol. % phosphoric acid, as in Example 1 except that the bias applied was increased to 30 volts positive bias on the coupon (with respect to the anodizing electrolyte). After 10 minutes at 30 volts, the leakage current through the anodic oxide film on the coupon decreased from an initial value of approximately 20 milliamperes to approximately 0.53 milliampere, indicating the presence of an insulating, traditional anodic oxide film. This produced a film equivalent to 30 anodizing volts or 5–10 times thicker than has been found necessary for the transition to non-thickness-limited anodic oxide growth with tantalum anode materials.

The coupon was then transferred to the same non-thickness-limited anodizing electrolyte that was used in Example 1, again at a temperature above the approximately 150° C. initiation point for non-thickness-limited anodic oxide production. A current of approximately 0.4 milliampere/cm$^2$ was applied for 10 minutes. During this exposure to non-thickness-limited anodizing conditions, the voltage across the cell (mainly voltage drop across the oxide film) was observed to decrease, from approximately 18 volts initially to approximately 2.25 volts at the end of 10 minutes. The coupon was then removed from the non-thickness-limited electrolyte, washed, and examined.

The oxide did not grow appreciably thicker (same interference color as before exposure to N-T-L conditions). The edges of the coupon were found to have oxide damage or gray-out present due to the passage of current through the oxide.

The above examples illustrate the difficulty of applying the method of pre-anodizing anode materials conventionally prior to non-thickness-limited anodizing for the purpose of facilitating initiation of non-thickness-limited anodic oxide growth (as described in co-pending Ser. No. 09/265,593) to niobium and high niobium content alloys.

Example 3 (Invention)

In order to illustrate the efficacy of the method of the invention, a coupon was cut from Cabot niobium/1% zirconium foil, as in Examples 1 and 2. This coupon was acetone washed, as in Examples 1 and 2. The coupon was then immersed in the same non-thickness-limited anodizing electrolyte used in Examples 1 and 2, with approximately 25 cm$^2$ immersed in the electrolyte. The electrolyte temperature was maintained between 155° C. and 165° C. for the duration of the test. The electrolyte water content was initially below 0.1 wt. %.

The coupon was biased positive, with an available current density of 0.4 milliampere/cm$^2$. After 5 minutes, the voltage had risen from 0.98 volts to only 1.12 volts. Essentially no anodic oxide growth was observed.

At this time, 1% water was added to the electrolyte (as a 50% solution in glycerine to prevent boiling). The voltage began to rise immediately, reaching 3.27 volts within 1 minute and 9.32 volts within 20 minutes of the water addition. Twenty minutes after the first water addition, an additional 1% water was added to the electrolyte solution. Twenty minutes after the second addition, a third addition of 1% water was made to the electrolyte solution. Although the anodizing efficiency was low and the current unstable during this traditional anodizing portion of the anodic oxide formation (probably due to the very high anodizing temperature and inherent instability of anodic niobium oxide), within 3 hours of the third water addition, the current had decayed to approximately 0.18 milliampere/cm$^2$.

During the course of the anodizing, after the third de-ionized water addition, the electrolyte solution decreased in water content due to the high electrolyte temperature (160+° C.). After approximately 3 hours, the electrolyte was sufficiently low in water content (i.e., below approximately 0.1 wt. %) for N-T-L anodic oxide formation to be detectable by an increase in the cell current. The anodizing current rose steadily over the next 3 hours as the electrolyte dried further. The final current had risen to 0.28 milliampere/cm$^2$.

The coupon, which had undergone non-thickness-limited anodic oxide formation for at least 3 hours (as indicated by the increasing current through the anodizing cell), was bent double, so as to crack the anodic oxide, then the coupon was subjected to scanning electron microscope examination. The anodic oxide film was found to be approximately 2.8 microns thick. This film is, then, over 30 times thicker than would be expected for a traditionally formed anodic oxide film on niobium.

This example demonstrates raising the water content of an non-thickness-limited type of anodizing electrolyte solution to 1–3 wt %, anodizing a niobium or high niobium content alloy anode material in the electrolyte at this water content, then allowing the water content to be reduced through evaporation at a temperature above about 150° C. with positive bias applied to the anode material, produces a sufficiently stable anodic film so that the transition to non-thickness-limited anodic oxide formation.

Example 4 (Comparative)

In order to demonstrate that the successful transition from traditional anodic oxide growth to non-thickness-limited anodic oxide growth requires the addition of water to the non-thickness-limited electrolyte and cannot be produced by merely reducing the non-thickness-limited electrolyte temperature to significantly below 150° C., anodizing the niobium material in the reduced temperature/low water electrolyte solution, then, raising the electrolyte temperature above about 150° C. with positive bias applied, the following experiment was conducted.

A 10 wt. % solution of dibasic potassium phosphate in glycerine was prepared and was dried by heating to 156° C. to 158° C. for 17 hours. The electrolyte temperature was then reduced to 100° C. to 110° C.

A coupon was cut from Cabot niobium/1% zirconium foil and acetone washed as in the first three examples. The foil coupon was immersed in the electrolyte solution and a current of 0.4 milliampere/cm2 was applied. The voltage across the cell increased to 30 volts (the voltage set point) within 11 minutes and the current decayed, as is the case with traditional barrier anodic oxide film formation. Within 30 minutes of the application of positive bias to the coupon, the current had decayed to less than 0.04 milliampere/cm$^2$.

At this point (30 minutes after the first application of voltage bias to the coupon), the electrolyte solution temperature was increased. As the temperature rose to approximately 160° C., the current increased to the 0.4 milliampere/cm$^2$ set point and the voltage dropped to less than 2 volts.

The coupon was then held at 0.4 milliampere/cm$^2$ for over 2 hours at a temperature above 150° C. and with an electrolyte solution water content of less than 0.1%. At the end of this time, the coupon was examined and was found to have grayed-out badly (seriously flawed anodic oxide) with no evidence of non-thickness-limited anodic oxide growth.

Example 5 (Invention)

In order to illustrate the method of the present invention with a niobium substrate, a coupon was cut from niobium foil, 99.8%, and was acetone-rinsed to remove any rolling oils, etc.

The coupon was then suspended partially immersed in a 10 wt. % solution of dibasic potassium phosphate in glycerine contained in a stainless steel beaker. This electrolyte solution had previously been dried to reduce the water content to less than 0.1 wt. % water by heating at 150–160° C. for approximately 7 hours.

The coupon was connected to the positive pole, and the beaker to the negative pole of a constant current/constant voltage power supply set to deliver a maximum voltage of 30 volts and a maximum current such that the maximum current density available was 0.35 milliampere/$cm^2$ of coupon surface.

Current was then applied to the cell. After 5 minutes with 0.35 mA/$cm^2$ current flow, the voltage across the cell was approximately 1.5 volts and was essentially the same for the 5 minute hold time (i.e., no evidence of anodic film growth).

With the current applied, 1.6 wt. % water was added to the cell (stirred with a magnetic stirring bar) as a 50% glycerine solution. The voltage began to rise immediately with the water addition as follows:

| Time After $H_2O$ Addition | Voltage | Current |
|---|---|---|
| (0) | 1.5 volts | 0.35 mA/$cm^2$ |
| 5 minutes | 9.1 volts | 0.35 mA/$cm^2$ |
| 10 minutes | 18.2 volts | 0.35 mA/$cm^2$ |
| 15 minutes | 28.0 volts | 0.35 mA/$cm^2$ |
| 16 minutes | 30.2 volts | dropping |
| 20 minutes | 30.2 volts | 0.115 mA/$cm^2$ |
| 25 minutes | 30.2 volts | 0.090 mA/$cm^2$ |

The above data is typical of traditional anodic oxide films formed in organic electrolyte solutions at this temperature (155–160° C.).

The solution/coupon were held at temperature with voltage applied across the cell in order to allow the water to evaporate so as to reduce the water content of the electrolyte to less than about 0.1 wt. %.

Upon thermally reducing the water content of the solution to the level required for the onset of non-thickness-limited anodizing behavior (i.e., below approximately 0.1 wt. %), the current began to increase, eventually reaching the preset limit of the power supply, at which time the voltage level required to drive the current through the anodic oxide (producing N-T-L oxide growth) also decayed. The voltage/current history is as follows:

| Time After $H_2O$ Addition | Voltage | Current |
|---|---|---|
| 1 Hr. 35 min | 30 volts (dropping) | 0.35 mA/$cm^2$ |
| 2 Hrs. | 28 volts | 0.35 mA/$cm^2$ |
| 3 Hrs. | 28.5 volts | 0.35 mA/$cm^2$ |
| 4 Hrs. | 29 volts | 0.35 mA/$cm^2$ |
| 5 Hrs. | 24 volts | 0.35 mA/$cm^2$ |
| 6 Hrs. | 8.5 volts | 0.35 mA/$cm^2$ |
| 7 Hrs. | 7.0 volts | 0.35 mA/$cm^2$ |
| 8 Hrs. | 6.8 volts | 0.35 mA/$cm^2$ |
| 9 Hrs. | 7.0 volts | 0.35 mA/$cm^2$ |
| 10 Hrs. | 7.0 volts | 0.35 mA/$cm^2$ |
| 11 Hrs. | 6.5 volts | 0.35 mA/$cm^2$ |
| 12 Hrs. | 3.0 volts | 0.35 mA/$cm^2$ |
| 13 Hrs. | 2.1 volts | 0.35 mA/$cm^2$ |
| 14 Hrs. | 1.0 volts | 0.35 mA/$cm^2$ |
| 15 Hrs. | 1.0 volts | 0.35 mA/$cm^2$ |
| 16 Hrs. | 1.0 volts | 0.35 mA/$cm^2$ |

Note: Temperature maintained at 155–160° C. during the test.

It may be seen from the above data that N-T-L anodizing behavior was induced by the addition of water to the N-T-L electrolyte to produce a traditional anodic oxide film. The water content was decreased to the point that N-T-L anodizing behavior ensued. The voltage decreased as the water content of the electrolyte solution dropped due to evaporation.

At 16 hours after the initial addition of 1.6 wt. % water, an additional 1.6 wt. % water was made to the N-T-L electrolyte (as a 50% aqueous glycerine solution). The voltage again began to increase immediately, reaching the 30 volt preset power supply limit, followed by decay of the current to 0.019 mA/$cm^2$ within 30 minutes of this water addition. Thus the film growth is of the non-thickness-limited variety and ceased upon increasing the water content of the electrolyte solution above about 0.1 wt. % water.

The coupon was then removed from the anodizing cell and rinsed to remove the electrolyte. The coupon was bent in order to crack the anodic oxide and then was examined with a scanning electron microscope. This examination revealed a relatively smooth and uniform anodic oxide was present, having a thickness of approximately 12 microns. This is the approximate equivalent of an anodic oxide film grown at 5000–6000 volts by traditional methods. (This voltage is an extrapolation based upon 20–25 angstroms per volt for anodic niobium oxide. It is not currently possible to grow a uniform anodic film on niobium above a few hundred volts using traditional anodizing techniques and electrolytes.)

It will be apparent to those skilled in the art that various modifications and variations can be made in the compositions and methods of the present invention without departing from the spirit or scope of the invention. Thus, it is intended that the present invention covers the modifications and variations of this invention provided they come within the scope of the appended claims and their equivalents.

What is claimed:

1. A method of non-thickness-limited anodizing of a valve metal or valve metal alloy substrate comprising immersing the substrate in a first glycerine-based electrolyte comprising more than 0.1 wt % water and at a temperature of at least 150° C., and applying sufficient first anodizing potential to form an oxide film on the substrate;

then immersing the substrate in a second glycerine-based electrolyte having less than about 0.1 wt % water and at a temperature of at least 150° C., and applying sufficient second anodizing potential to form a non-thickness limited oxide film on the substrate.

2. The method of claim 1 wherein the first glycerine-based electrolyte comprises about 1 wt % to about 3 wt % water.

3. The method of claim 1 wherein the first anodizing potential applied is about 5 to about 30 volts.

4. The method of claim 1 wherein the substrate is niobium or a niobium-containing alloy.

5. The method of claim 1 further comprising allowing the water to evaporate from the first electrolyte to form the second electrolyte having less than about 0.1 wt. % water.

6. The method of claim 5 further comprising allowing the water to evaporate while maintaining an electrolyte temperature above about 150° C.

7. The method of claim 5 wherein an anodizing potential of about 5 to about 30 volts is applied during evaporation.

8. The method of claim 1 wherein the first glycerine-based electrolyte solution comprises dibasic potassium phosphate, potassium toluene sulfonate, or potassium hydrogen tartrate.

9. The method of claim 1 wherein the second glycerine-based electrolyte solution comprises dibasic potassium phosphate, potassium toluene sulfonate, or potassium hydrogen tartrate.

10. A method of non-thickness-limited anodizing of a valve metal or valve metal alloy substrate comprising immersing the substrate in a first glycerine-based electrolyte comprising more than 0.1 wt % water and at a temperature of at least 150° C., and applying sufficient first anodizing potential to form an oxide film on the substrate;

then evaporating the water in the first electrolyte while maintaining the temperature at least 150° C. to form a second glycerine-based electrolyte having less than about 0.1 wt % water, and applying sufficient second anodizing potential to form a non-thickness limited oxide film on the substrate.

11. The method of claim 10 wherein the first glycerine-based electrolyte comprises about 1 wt % to about 3 wt % water.

12. The method of claim 10 wherein the first anodizing potential applied is about 5 to about 30 volts.

13. The method of claim 10 wherein the substrate is niobium or a niobium-containing alloy.

14. The method of claim 10 wherein an anodizing potential of about 5 to about 30 volts is applied during evaporation.

15. The method of claim 10 wherein the first glycerine-based electrolyte solution comprises dibasic potassium phosphate, potassium toluene sulfonate, or potassium hydrogen tartrate.

* * * * *